US009004078B2

(12) United States Patent
Didieu

(10) Patent No.: US 9,004,078 B2
(45) Date of Patent: Apr. 14, 2015

(54) DECORATIVE DEVICES, AND METHODS FOR MAKING AND USING SAME

(71) Applicant: Federico Didieu, Spring, TX (US)

(72) Inventor: Federico Didieu, Spring, TX (US)

( * ) Notice: Subject to any disclaimer, the term of this patent is extended or adjusted under 35 U.S.C. 154(b) by 0 days.

(21) Appl. No.: 13/749,622

(22) Filed: Jan. 24, 2013

(65) Prior Publication Data

US 2014/0202482 A1 Jul. 24, 2014

(51) Int. Cl.

| | |
|---|---|
| ***A45D 2/20*** | (2006.01) |
| ***A45D 8/36*** | (2006.01) |
| ***A45D 8/00*** | (2006.01) |
| *A45D 8/34* | (2006.01) |

(52) U.S. Cl.

CPC .. *A45D 8/36* (2013.01); *A45D 8/00* (2013.01); *A45D 8/34* (2013.01); *A45D 2008/002* (2013.01); *A45D 2008/006* (2013.01)

(58) Field of Classification Search

USPC ..... 132/245–247, 261

See application file for complete search history.

(56) References Cited

U.S. PATENT DOCUMENTS

| | | | | | |
|---|---|---|---|---|---|
| 2,693,809 | A * | 11/1954 | Spencer | 132/246 |
| 4,540,006 | A * | 9/1985 | Collis | 132/246 |
| 5,669,398 | A * | 9/1997 | Dadgostar | 132/210 |
| 5,694,955 | A * | 12/1997 | Grooms | 132/246 |
| D430,704 | S * | 9/2000 | Spurrell et al. | D28/39 |
| 6,397,854 | B1 * | 6/2002 | Bailey | 132/200 |
| 2003/0015212 | A1 * | 1/2003 | Clay | 132/246 |

* cited by examiner

*Primary Examiner* — Rachel Steitz

(74) *Attorney, Agent, or Firm* — Krueger Iselin LLP

(57) ABSTRACT

A disclosed decorative device includes an elongate, flexible foam body, an elongate, pliable core element, a pair of adapters, and a pair of end pieces. A method for making the decorative device is described, as is a method for retaining hair using the decorative device. The decorative device includes the elongate, flexible foam body surrounding the elongate, pliable core element along its length. The pair of adapters are each configured to fixably receive an end of the elongate, pliable core element, with the pair of end pieces, each being configured to connect to one of the pair of adapters.

14 Claims, 4 Drawing Sheets

DECORATIVE DEVICES, AND METHODS FOR MAKING AND USING SAME

BACKGROUND

Hairstyles in which hair on the head is pulled away from the face, gathered, secured at one or two places on the back of the head, and allowed to hang freely from those point(s), are popular with both men and women. The "ponytail" is a popular hairstyle in which most or all of the hair is gathered and secured at one place, commonly the middle of the back of the head or the base of the neck. The ponytail gets its name from its resemblance to the undocked tail of a horse or pony. "Pigtails" is a popular hairstyle in which the hair is parted down the middle and gathered into two bundles, one on each side of the head. The term "pigtail" originated from the resemblance of each of the secured bunches of hair to a twisted pig's tail.

In forming pigtails and ponytails, gathered bunches of hair are typically secured at or near the scalp with elastic bands, ribbons or strings, or barrettes. Each of these methods of securing bundled hair has drawbacks. Elastic bands can be difficult to position around bundled hair, and hair in contact with elastic bands is often pulled out when the bands are removed. Ribbons and strings must usually be tied around hair bundles by another person, and often slip away from the scalp during active use. Most barrettes are relatively complex and expensive mechanical devices.

It would thus be beneficial to have a relatively simple decorative device that can easily be installed by a user around his or her own bundled hair, and grips bundled hair with sufficient frictional force that the device stays in place even during active use.

SUMMARY

A disclosed decorative device includes an elongate, flexible foam body, an elongate, pliable core element, a pair of adapters, and a pair of end pieces. The foam body has two opposed ends with the core element substantially enclosed therein. The adapter connects the core element at each end to one of the end pieces. In assembly, the core element is preferably co-extruded with the foam body, and each end of the core element is attached through one of the adapters to one of the pair of end pieces.

The foam body may include expanded, closed-cell silicone sponge or foam material. Alternatively, the foam body may include a thermoplastic foam material such as polyethylene, polypropylene, or polyurethane foam. The foam body may include a closed cell foam material such that an outer surface of the foam body is water repellent at least to the extent that water penetrates the outer surface with difficulty. The foam body may be substantially cylindrical, and may have an outer diameter ranging from about 0.20 inches to about 0.75 inches, or alternatively from about 0.25 inches to about 0.30 inches.

The core element may be substantially cylindrical. A distance between the two ends of the foam body may define the length dimension of the foam body. The length dimension of the foam body may range from about 3 inches to about 12 inches, or alternatively from about 6 inches to about 10 inches. The core element may include a pliable metal. The core element may include one or more of aluminum, nickel, stainless steel, brass, or copper. The core element may include an aluminum wire having a diameter ranging from about 0.06 inches to approximately 0.10 inches.

The decorative device may include a fabric sleeve having a length dimension sufficient to cover an outer surface of the foam body. In assembly, the fabric sleeve may be positioned over the outer surface of the foam body such that the fabric sleeve covers the outer surface of the foam body. The fabric sleeve may include an elastic woven material that must be stretched in order to position the fabric sleeve over the outer surface of the foam body. When the fabric sleeve is positioned over the outer surface of the foam body, the elastic woven material may cause the fabric sleeve to cling to the outer surface of the foam body.

A disclosed method for making a decorative device includes providing the above described foam body, core element, pair of adapters, and pair of end pieces. The core element may be positioned in the opening of the foam body such that the core element extends through the foam body. Each end of the core element may be attached to the shank of one of the pair of end pieces such that the back surface of each of the end pieces is in contact with a corresponding one of the ends of the foam body. The shank of each of the pair of end pieces may include an opening dimensioned to receive an end of the core element, and the attaching may include: passing each end of the core element through the opening in the shank of one of the end pieces; and folding back the end piece onto the core element, thereby holding the end piece in place such that the back surface of each of the end pieces is in contact with a corresponding one of the ends of the foam body. In other embodiments, instead of a shank, an adapter may be used to join the core to the end piece. The core may attach using a set screw in a threaded hole in the side of the adapter that meets the core inside the body of the adapter to provide a frictional hold. The end piece may have a screw back received in the opposite end of the adapter from the core. The method may include positioning the above described fabric sleeve over the outer surface of the foam body such that the fabric sleeve covers the outer surface of the foam body.

A described method for retaining hair includes providing the above described decorative device. The hair is gathered into a bundle, and the decorative device is positioned around the bundled hair, thereby securing the bundled hair in place.

BRIEF DESCRIPTION OF THE DRAWINGS

A better understanding of the various disclosed embodiments can be obtained when the detailed description is considered in conjunction with the following drawings, in which.

Figure 1A:
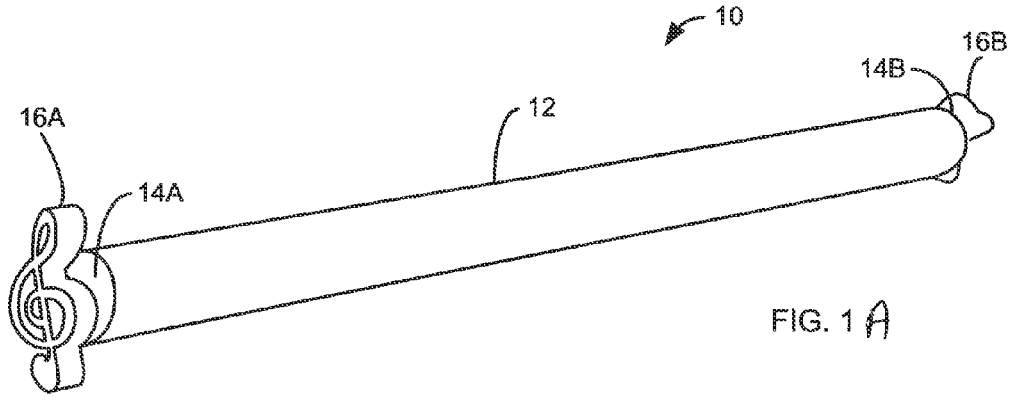
FIG. 1A is a perspective view of one embodiment of an assembled decorative device.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the scope of the present invention as defined by the appended claims.

DETAILED DESCRIPTION

Figure 2A:
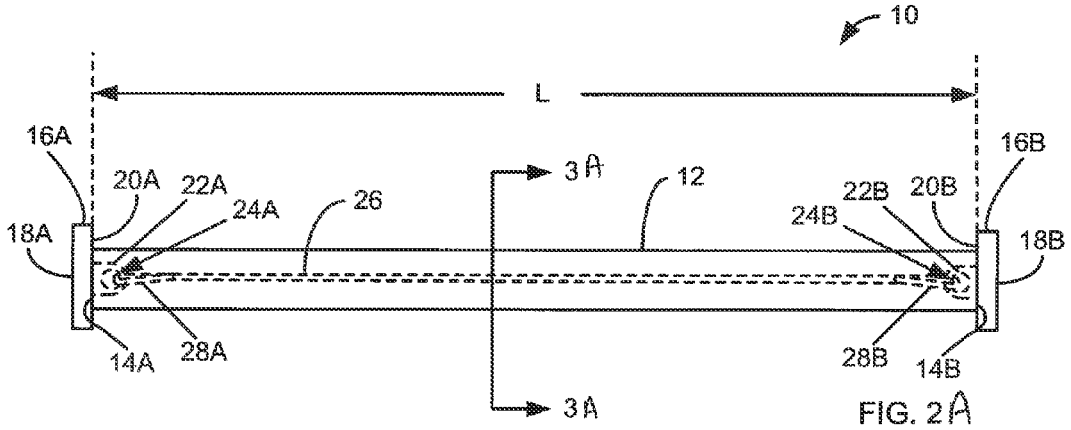
FIG. 2A is a side elevation view of the decorative device of FIG. 1A.
Figure 3A:
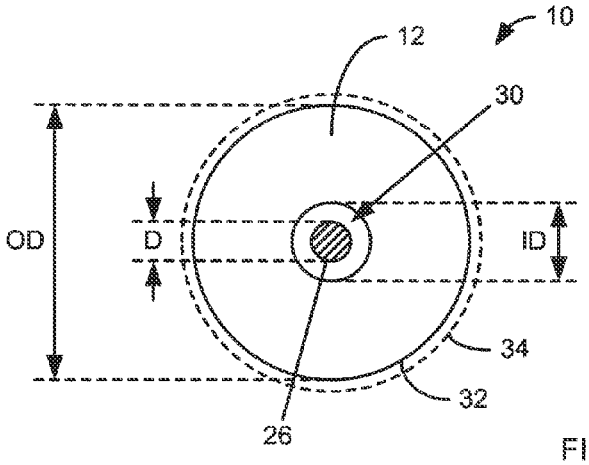
FIG. 3A is a cross-sectional view of the decorative device of FIG. 2A as indicated in FIG. 2A.

The problems identified in the background are at least partly addressed by the various embodiments of the disclosed decorative device, and methods for making and using the various embodiments of the decorative device. FIGS. 1A-3A will now be used to describe one embodiment of an assembled decorative device. FIG. 1A is a perspective view of one embodiment of an assembled decorative device 10. FIG. 2A is a side elevation view of the decorative device 10 of FIG. 1A, and FIG. 3A is a cross-sectional view of the decorative device 10 as indicated in FIG. 2A. The decorative device 10 of FIGS. 1A-3A is a relatively simple device that can easily be installed by a user around his or her own bundled hair. The decorative device 10 advantageously grips bundled hair with sufficient frictional force that the decorative device 10 stays in place even during active use.

In the embodiment of FIGS. 1A-3A, the decorative device 10 includes an elongate, flexible foam body 12 having two opposed ends 14A and 14B. A distance between the ends 14A and 14B of the foam body 12 defines a length dimension 'L' of the foam body 12 as indicated in FIG. 2. The decorative device 10 also includes a pair of end pieces 16A and 16B with opposed front and back surfaces. The end piece 16A has a front surface 18A and an opposed back surface 20A, and the end piece 16B has a front surface 18B and an opposed back surface 20B (see FIG. 2A). In the embodiment of FIGS. 1A-3A, the back surface 20A of the end piece 16A is in contact with the end 14A of the foam body 12, and the back surface 20B of the end piece 16B is in contact with the end 14B of the foam body 12 (see FIG. 2A).

The end pieces 16A an 16B preferably have decorative shapes or markings on the front surfaces 18A and 18B. In the embodiment of FIGS. 1A-3A, the end pieces 16A and 16B are shaped like music symbols. The end piece 16A is shaped like the distinctive 'treble clef' or 'G clef' music symbol, the symbol used to indicate that the second line from the bottom of a staff represents the pitch of G above middle C. The end piece 16B is shaped like the distinctive 'eighth not' music symbol, the symbol for a musical note played for one eighth the duration of a whole note. The eighth note music symbol includes an oval, filled-in note head and a straight note stem with one flag. In other embodiments, the end pieces 16A and 16B have decorative markings on the front surfaces 18A and 18B. In one particular embodiment, the end pieces 16A and 16B are round and have 'smiley faces' fixed to the front surfaces 18A and 18B. In various embodiments, the end pieces may have logos, pictures, photographs, gemstones, precious, semi-precious, or replica stones, and/or symbols on the outer face.

The foam body 12 has an opening 30 extending between the two ends 14A and 14B (see FIG. 3A). An elongate, pliable core element 26 extends within the opening 30 of the foam body 12 (see FIG. 2A). The core element 26 has two opposed ends 28A and 28B, and a length dimension that is greater than the length dimension 'L' of the foam body 12 (see FIG. 2A). In the embodiment of FIGS. 1A-3A, the length dimension of the core element 26 exceeds the length dimension 'L' of the foam body foam body by a distance ranging from about 0.25 inches to approximately 1.5 inches.

In the embodiment of FIGS. 1A-3A, the core element 26 is easily bent or shaped, tends to retain its shape after being bent, and can be bent repeatedly without damage. The foam body 12 conforms to the shape of the core element 26. The core element 26 preferably includes a pliable metal such as aluminum, nickel, stainless steel, brass, or copper. In the embodiment of FIGS. 1A-3A, the core element 26 includes an aluminum wire having a diameter ranging from about 0.06 inches to approximately 0.10 inches.

The end pieces 16A and 16B each have a shank extending from the back surface, where the shank is adapted for attachment to an end of the core element 26. In the embodiment of FIGS. 1A-3A, the end piece 16A has a shank 22A extending from the back surface 20A, where the shank 22A has an opening 24A dimensioned to receive the end 28A of the core element 26. The end piece 16B has a shank 22B extending from the back surface 20B, where the shank 22B has an opening 24B dimensioned to receive the end 28B of the core element 26.

As described above, the FIGS. 1A-3A show one embodiment of the decorative device 10 in assembly, where the core element 26 is positioned in the opening 30 of the foam body 12 such that the core element 26 extends through the foam body 12. The end 28A of the core element 26 is attached to the shank 22A of the end piece 16A such that the back surface 20A of the end piece 16A is in contact with the end 14A of the foam body 12, and the end 28B of the core element 26 is attached to the shank 22B of the end piece 16B such that the back surface 20B of the end piece 16B is in contact with the end 14B of the foam body 12.

More specifically, the end 28A of the core element 26 passes through the opening 24A in the shank 22A of the end piece 16A, and is folded back onto the core element 26, thereby holding the end piece 16A in place. Similarly, the end 28B of the core element 26 passes through the opening 24B in the shank 22B of the end piece 16B, and is folded back onto the core element 26, thereby holding the end piece 16B in place.

The end pieces 16A an 16B preferably substantially cover the ends 14A and 14B of the foam body 12. In the embodiment of FIGS. 1A-3A, the back surface 20A of the end piece 16A is large enough that it substantially covers the end 14A of the foam body 12, and the back surface 20B of the end piece 16B is large enough that it substantially covers the end 14B of the foam body 12.

An outer surface 32 of the foam body 12 is indicated in FIG. 3A. The outer surface 32 is preferably water repellent at least to the extent that water penetrates the outer surface 32 difficulty. In some embodiments, the foam body 12 is made of expanded, closed-cell silicone sponge or foam material. Closed cell foam structure typically forms an integral surface skin, leading to very low water absorption. The foam body 12 also preferably has high compressibility and low compression set over a wide temperature range. Other materials for the foam body 12 believed to be suitable include thermoplastic foam materials such as polyethylene, polypropylene, and polyurethane foam.

After much experimentation, a preferred composition for the foam body 12 (and all foam bodies herein) is comprised of a thermoplastic elastomer, a co-polymerization agent(s), a compatible foaming agent, and a compatible coloring concentrate. In one embodiment, the foam body 12 is comprised of Kraton® G7705 compound, SBS (styrene butadiene styrene), the compatible foaming agent and the compatible coloring concentrate.

In the embodiment of FIGS. 1A-3A, the length dimension 'L' of the foam body 12 ranges from about 3 inches to approximately 12 inches (see FIG. 2A). The foam body 12 is substantially cylindrical, and has an outer diameter 'OD' ranging from about 0.25 inch to approximately 0.75 inch (see FIG. 3A). Cross-sectional shapes of the foam body 12 other than circular are also possible, and include oval and polygonal shapes.

In the embodiment of FIGS. 1A-3A, the opening 30 of the foam body 12 is also substantially cylindrical, and defines an inner diameter 'ID' of the foam body 12 (see FIG. 3A). Cross-sectional shapes of the opening 30 other than circular are also possible, and include oval and polygonal shapes.

In the embodiment of FIGS. 1A-3A, the core element 26 is substantially cylindrical, and the inner diameter 'ID' of the foam body 12 is greater than a diameter 'D' of the core element 26 (see FIG. 3A). Cross-sectional shapes of the core element 26 other than circular are also possible, and include oval and polygonal shapes. As is discussed below, the core element 26 may also include a plurality of wires of one or more compositions (see 26B below).

An optional fabric sleeve 34 that may be positioned over the outer surface 32 of the foam body 12 is indicated in FIG. 3A. The optional fabric sleeve 34 has a length dimension sufficient to cover the outer surface 32 of the foam body 12. In some embodiments, the fabric sleeve 34 includes an elastic woven material that must be stretched in order to position the fabric sleeve 34 over the outer surface 32 of the foam body 12. When the fabric sleeve 34 is positioned over the outer surface 32 of the foam body 12, the elastic woven material causes the fabric sleeve 34 to cling to the outer surface 32 of the foam body 12.

While the embodiments disclosed with respect to FIGS. 1A-3A may include the shanks 22A, 22B as the attachment mechanism between the core element 26 and the end pieces 16A, 16B, other embodiments may include adapters as the attachment mechanism between the core element 26B and the end pieces 16C, 16D. In addition, the embodiments disclosed with respect to FIGS. 1A-3A include a ID 30 for the foam body 12, other embodiments simply require the foam body 12B to be found around the core 26B, as shown in FIGS. 3B and 3C. As an additional embodiment, the outer surface of the foam body may include ridges as shown in FIG. 1D.

Figure 1B:
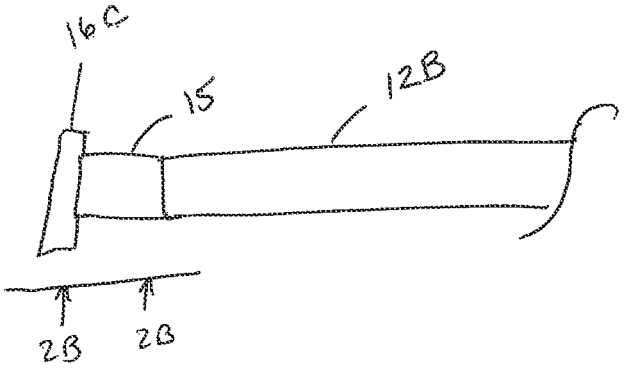
FIG. 1B is a perspective view of an end portion of another embodiment of an assembled decorative device.
Figure 2B:
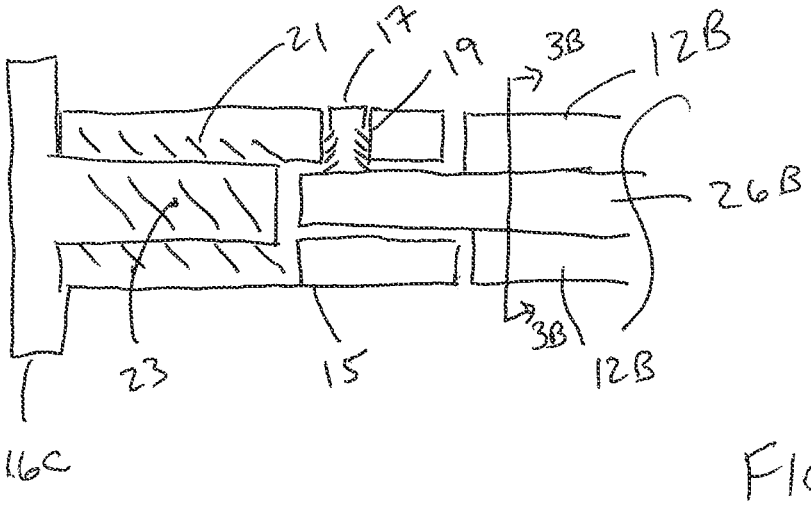
FIG. 2B is a side elevation view of the decorative device of FIG. 1B.

Turning now to the additional embodiments, note that letters on figure numbers are not different elements, but only alternative elements that are interchangeable with other embodiments and configurations. In FIG. 1B, the perspective view of one end portion of another embodiment of an assembled decorative device 10B is shown as a cut-away. The end of the foam body 12B abuts an embodiment of the adapter 15. The other side of the adapter is flush to end piece 16C. The designation of where FIG. 2B is located is shown to cover the end elements of the foam body 12B. In this embodiment of the adapter 15, the adapter 15 is substantially cylindrical in shape to generally match the OD of the foam body 12B.

FIG. 2B shows the side elevation of a portion of the end of the decorative device 10B of FIG. 1B. Moving from left to right, the end piece 16C is shown as an embodiment with a screw back 23 to mate with threads 21 inside the adapter 15. In one preferred embodiment, the threads 21 and screw back 23 are sized 10-32. In various embodiments, the end pieces 16C are removable and replaceable. In other embodiments, the threads may be glued for a more permanent attachment between the end piece 16C and the adapter 15. Other attachment mechanisms are contemplated, including soldering and simply unifying the adapter and the end piece. For alternative removable attachments, clasps and other detachable jewelry connectors are contemplated.

The attachment mechanism between the adapter 15 and the core element 26B is shown as a set screw 17 through a hole 19 in the side of the adapter 15. The set screw 17 creates a frictional hold on the core element 26B, when the set screw 17 is tightened down. Glue or soldering may be used to more permanently fix the set screw in place. Other mechanisms for connecting the end piece 16C to the core element 26B are contemplated, such as soldering or welding, threads, or clips. The core element 26B is shown inserted in the opposite end of the adapter 15 from the end piece 16C and inside the foam body 12B. The designation of where FIG. 3B is located is shown.

Figure 1C:
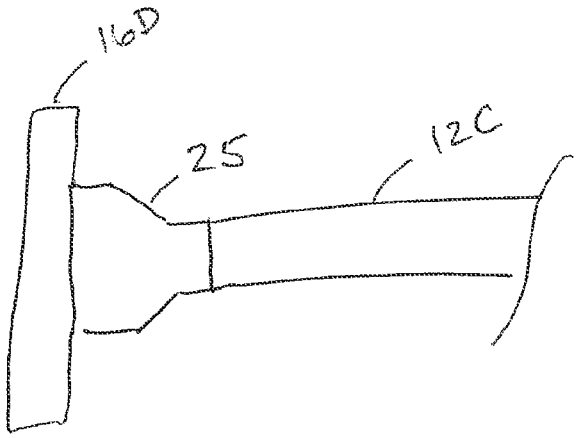
FIG. 1C is a perspective view of an end portion of still another embodiment of an assembled decorative device.

Turning to FIG. 1C, a perspective view of an end portion of another embodiment of an assembled decorative device including a preferred embodiment of the adapter 25 is shown. The adapter 25 is similar to the adapter 15 shown in FIG. 1B. In this embodiment, one end of the adapter 25 is sized on one end to substantially meet with the OD of the foam body 12C. The other end of the adapter 25 is sized to flare outward to provide a more stable interface with the end piece 16D. Experiments with various assembling techniques also showed that flared body on the adapter 25 provided a benefit in assembly times and relative ease in the (re)placement of end pieces 16.

Figure 3B:
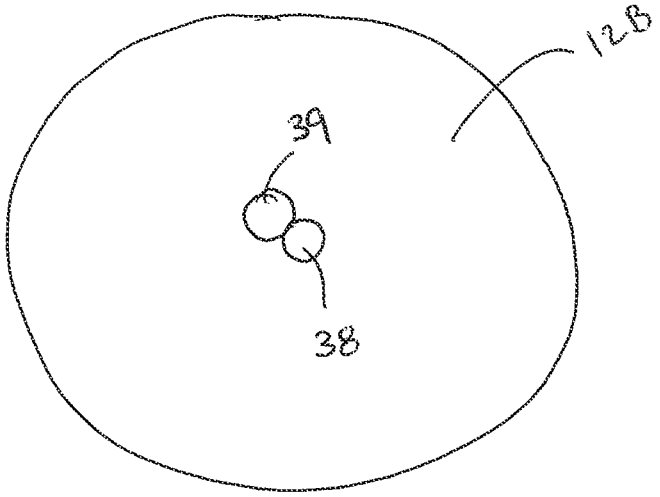
FIG. 3B is a cross-sectional view of an embodiment of the decorative device with two wires as the core element.
Figure 3C:
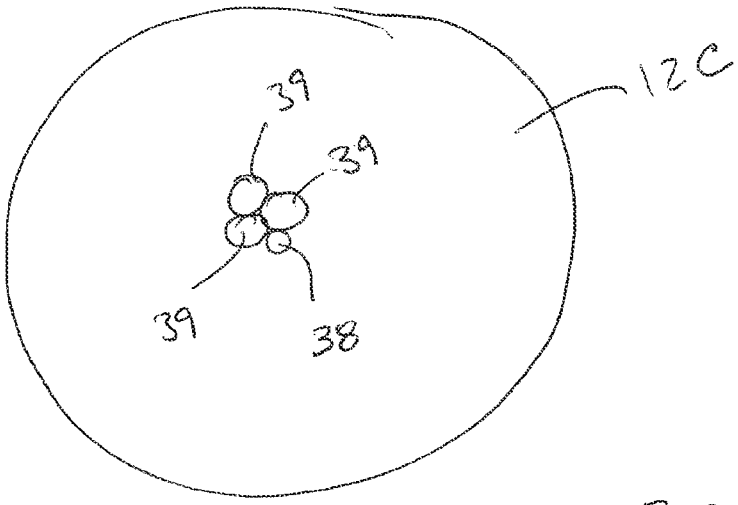
FIG. 3C is a cross-sectional view of an embodiment of the decorative device with four wires as the core element.

In FIGS. 3B and 3C, illustrations of various embodiments of the composition of the core element 26, 26B, 38, 39 and the relationship between the core element and the foam body 12 are shown. FIG. 3B shows the core element 26B as including a first core element 38 and a second core element 39. FIG. 3C shows the core element 26B as including a first core element 38 and a plurality of second core elements 39. Experimentation with a variety of core elements 26 has led to the preferred embodiment of FIG. 3C, where the core element 38 is a stainless steel wire twisted with three aluminum wires 39. In general terms, the core element 26 shown in FIG. 3B represents the features of the preferred embodiment in terms of a first core element 30 with the resiliancy to be repeatedly manipulated without breaking (i.e., structural integrity) and a second core element 39 with the "memory" to remain in its bent position without spring-back. In general, these two traits are opposing in that most materials that express the desirable property of first core element 38 are lacking in their magnitude of the desired property of the second core element 39, and vice versa. Experiments included using wires of varying composition and diameters, in varying numbers and methods of twisting, braiding and stranding. Experiments also included various coated and galvanized wires.

As examples: A single aluminum wire (39) provides a reasonable hold of position but is prone to breakage upon repeated flexing at a single point, causing the decorative element 10 to fail structurally. A single stainless steel wire (38) provides reasonable durability and resistance to repeated flexing, but has a tendency to springback and not hold position. Strands of ratio 1:1 of core elements 38:39 and ratios 1:2 combined the benefits of both individual wires but caused difficulties in the preferred manufacturing process of co-extruding the wires and the foam. Repeated failures of the process led to the preferred embodiment of a ratio of 1:3, where the stainless steel wire and the aluminum wires are stranded together with a twist to form a central core with on OD in the range of about 0.115 inches to about 0.125 inches. The preferred sizes are about 0.025 inch diameter for the T302 stainless steel wire and 0.050 inch diameter for the three aluminum 1100 wires. Note that non-metallic core elements may be used for either core element 38 or 39, but mostly likely for core element 38 for structural integrity of the decorative element 10.

Figure 1D:
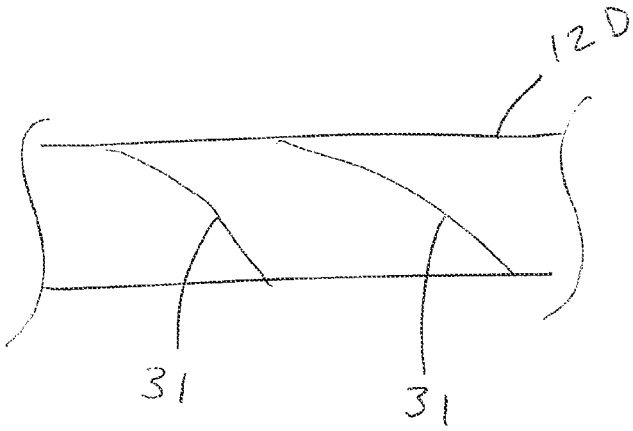
FIG. 1D is a perspective view of a middle portion of one embodiment of an assembled decorative device.

Turning to FIG. 1D, the perspective view of a middle portion of one embodiment of an assembled decorative device 10 is shown. As illustrated, the outer surface of the foam body 12D has ridges running generally perpendicular to the length of the decorative device 10 as an aid in maintaining position when placed is use, such as when used to hold a ponytail of hair. The ridges 31 may be of varying shape and size. The ridges 31 may be separate rings around the generally cylindrical shape. The ridges 31 may also be formed from a continuous spiral from end to end of the foam body, as shown in FIG. 1D. The ridges 31 may also be formed as non-symmetrical groups of one or more loops around the decorative device 10.

A method for making the decorative device 10 of FIGS. 1A-3A includes providing the foam body 12, the core element 26 and the end pieces 16A and 16B. The core element 26 is positioned in the opening 30 of the foam body 12 such that the core element 26 extends through the foam body 12 as indicated in FIG. 2. The end 28A of the core element 26 is attached to the shank 22A of the end piece 16A such that the back surface 20A of the end piece 16A is in contact with the end 14A of the foam body 12, and the end 28B of the core element 26 is attached to the shank 22B of the end piece 16B such that the back surface 20B of the end piece 16B is in contact with the end 14B of the foam body 12 (see FIG. 2).

As described above and indicated in FIG. 2, the end 28A of the core element 26 may be passed through the opening 24A in the shank 22A of the end piece 16A, and the end 28A may be folded back onto the core element 26, thereby holding the end piece 16A in place such that the back surface 20A of the end piece 16A is in contact with the corresponding end 14A of the foam body 12. Similarly, the end 28B of the core element 26 may be passed through the opening 24B in the shank 22B of the end piece 16B, and the end 28B may be folded back onto the core element 26, thereby holding the end piece 16B in place such that the back surface 20B of the end piece 16B is in contact with the corresponding end 14B of the foam body 12. The fabric sleeve 34 may be positioned over the outer surface 32 of the foam body 12 such that the fabric sleeve 34 covers the outer surface 32 of the foam body 12 (see FIG. 3).

In contrast, the preferred method of making the foam body 12B with core elements 26B includes positioning at least three first core elements around a central core element to form a combined core and co-extruding the combined core with a foaming composition to form a foam body surrounding the combined core. In one preferred embodiment, stranding the first core elements with the central core element provided an improved manufacturing result. Co-extrusion may include the technique known in the art as "tubing the wire".

The method may also include attaching each end of the combined core to a first end of an adapter. The method may further include attaching a second end of the adapter to an end piece. The attachment to the end piece may be removable or fixed. A removable end piece would allow the user to replace the end piece with a variety of decorations as desired.

Extensive experimentation with the extrusion machines shows that the size and setting of the barrier/mixing screw on the extrusion machine may be critical to creating a desirable texture and composition of the foam body 12. In a preferred embodiment, using a preferred composition mixture, a 3:1 or 3.5:1 polyethylene screw adjusted for the exact ratios of the foam body composition gives desirable results in the finished product.

Figure 4:
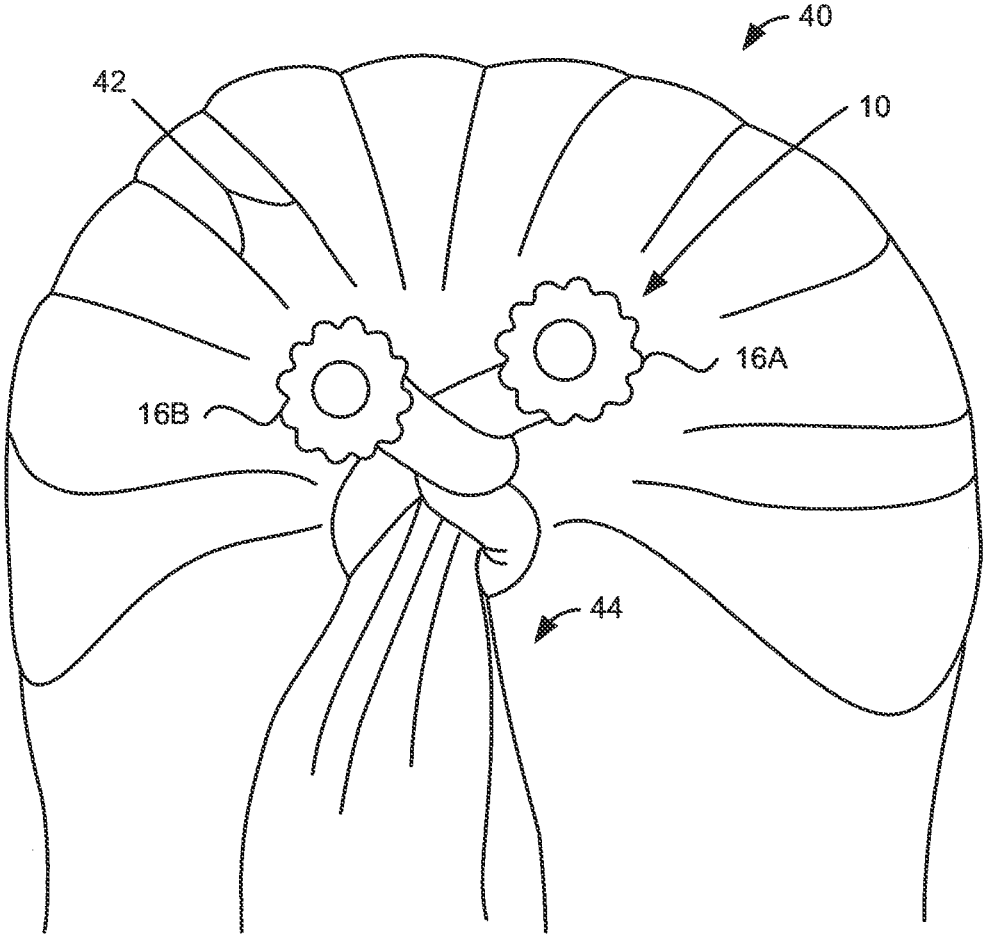
FIG. 4 is a view of a back of a wearer's head where the wearer's hair is secured at the middle of the back of the wearer's head using any embodiment of the decorative device 10.

FIG. 4 is a view of a back of a wearer's head 40 where hair 42 of the wearer is secured at the middle of the back of the wearer's head 40 using the decorative device 10 of FIGS. 1-3. In the embodiment of FIG. 4, the end pieces 16A and 16B of the decorative device 10 are shaped like flowers, more specifically daisies. In FIG. 4, the decorative device 10 is being used to implement the ponytail hairstyle described above.

In one embodiment of a method for retaining the hair 42, the hair 42 is gathered from around the wearer's face to form a hair bundle 44 at the middle of the back of the wearer's head 40. The decorative device 10 is positioned around the hair bundle 44, and ends of the decorative device 10 are wrapped around each other as shown in FIG. 4, thereby securing the hair bundle 44 in place at the middle of the back of the wearer's head 40. The decorative device 10 can easily be installed by the wearer, and advantageously grips the hair bundle 44 with sufficient frictional force that the decorative device 10 stays in place even when the wearer is active.

Numerous variations and modifications will become apparent to those skilled in the art once the above disclosure is fully appreciated. For example, the end pieces may be selected from an endless variety of decorative buttons, beads, pins, or stones. The attachment method for the end pieces can be varied, with different hole placements and retaining configurations. The selection of color and decorative end pieces can be made to emphasize a theme, such as: patriotism; team spirit; membership in a church, club, or society; a hobby such as music, gardening, cheerleading, reading; etc. It is intended that the following claims be interpreted to embrace all such variations and modifications.

What is claimed is:

1. A decorative device, comprising:

an elongate, pliable core having two opposed ends, wherein the enlongated, pliable core comprises a plurality of core elements including a first structural core element and a plurality of second core elements, composed of a material different from the first structural core element, that tends to hold position when bent; wherein the first structural core element and the plurality of second core elements are twisted together;

an elongate, flexible foam body having two opposed ends and a length dimension that is substantially equal or slightly less than a length dimension of the elongate, pliable core element, wherein the elongate, pliable core is enclosed within the elongate, flexible foam body along the length dimension with a portion of the elongate, pliable core extending beyond each end of the elongate, flexible foam body;

a pair of adapters, each configured to fixably receive an end of the elongate, pliable core element, wherein each of the pair of adapters is adjacent an end of the elongate, flexible foam body; and a pair of decorative end pieces, each configured to connect to one of the pair of adapters.

2. The decorative device as recited in claim 1, wherein each of the plurality of second core elements comprises aluminum wire with a diameter in a range from about 0.05 inches to about 0.10 inches.

3. The decorative device as recited in claim 1, wherein the plurality of core elements includes of a stainless steel wire and three aluminum wires, wherein the plurality of core elements are twisted together.

4. The decorative device as recited in claim 1, wherein the length dimension of the core available for insertion into each adapter is about 0.125 inches.

5. The decorative device as recited in claim 1, wherein a back surface of at least one of the end pieces is dimensioned to substantially cover an end of the adapter.

6. The decorative device as recited in claim 1, wherein the elongate, flexible foam body comprises expanded, closed-cell silicone sponge or foam material.

7. The decorative device as recited in claim 1, wherein the elongate, flexible foam body comprises a thermoplastic foam material.

8. The decorative device as recited in claim 1, wherein the elongate, flexible foam body comprises polyethylene, polypropylene, or polyurethane foam.

9. The decorative device as recited in claim 1, wherein the elongate, flexible foam body comprises a closed cell foam material such that an outer surface of the foam body is water repellent at least to the extent that water penetrates the outer surface with difficulty.

10. The decorative device as recited in claim 1, wherein the elongate, flexible foam body is substantially cylindrical, and has an outer diameter ranging from about 0.20 inch to approximately 0.75 inch.

11. The decorative device as recited in claim 10, wherein the elongate, flexible foam body has an outer diameter ranging from about 0.25 inch to approximately 0.30 inch.

12. The decorative device as recited in claim 1, wherein the length dimension of the foam body ranges from about 3 inches to approximately 12 inches.

13. The decorative device as recited in claim 12, wherein the length dimension of the foam body ranges from about 6 inches to approximately 10 inches.

14. The decorative device as recited in claim 1, further comprising:

a fabric sleeve having a length dimension sufficient to cover an outer surface of the foam body.

* * * * *